US005191862A

United States Patent [19]

Wirbeleit et al.

[11] Patent Number: 5,191,862

[45] Date of Patent: Mar. 9, 1993

[54] RECIPROCATING PISTON WITH VARIABLE COMPRESSION HEIGHT FOR INTERNAL COMBUSTION ENGINES

[75] Inventors: Friedrich Wirbeleit, Esslingen-Rüdern; Martin Bechtold, Stuttgart, both of Fed. Rep. of Germany

[73] Assignee: Daimler-Benz AG, Fed. Rep. of Germany

[21] Appl. No.: 887,811

[22] Filed: May 26, 1992

[30] Foreign Application Priority Data

May 25, 1991 [DE] Fed. Rep. of Germany ..... 4117131

[51] Int. Cl.[5] ..... F01B 31/14

[52] U.S. Cl. ..... 123/48 B; 123/78 B; 92/60.5; 92/82; 92/143

[58] Field of Search ..... 123/48 R, 48 B, 78 R, 123/78 B, 193 P; 92/60.5, 82, 143

[56] References Cited

U.S. PATENT DOCUMENTS

| | | | |
|---|---|---|---|
| 3,303,831 | 2/1967 | Sherman | 92/82 |
| 3,450,111 | 6/1969 | Cronstedt | 123/78 B |
| 3,527,264 | 9/1970 | Bachle | 123/48 B |
| 3,656,412 | 4/1972 | Wilson | 92/82 |
| 4,079,707 | 3/1978 | Karaba et al. | 123/78 B |
| 4,809,650 | 3/1989 | Arai et al. | 123/48 B |
| 4,864,977 | 9/1989 | Hasegawa | 123/48 B |
| 4,934,347 | 6/1990 | Suga et al. | 123/48 B |
| 4,979,427 | 12/1990 | Pfeffer et al. | 123/48 B |

*Primary Examiner*—David A. Okonsky

*Attorney, Agent, or Firm*—Evenson, Wands, Edwards, Lenahan & McKeown

[57] ABSTRACT

A reciprocating piston is disclosed with variable compression height for internal combustion engines in particular. For structural simplification of the temperature-dependent change in the compression height of the reciprocating piston, a spring is provided which consists of a shape memory alloy and interacts with the pressure limiting valve. This permits temperature-dependent change in the compression height of the reciprocating piston exclusively by the pressure limiting valve so that structural simplification is achieved.

9 Claims, 2 Drawing Sheets

RECIPROCATING PISTON WITH VARIABLE COMPRESSION HEIGHT FOR INTERNAL COMBUSTION ENGINES

BACKGROUND AND SUMMARY OF THE INVENTION

The invention concerns a reciprocating piston with variable compression height for internal combustion engines in particular.

A reciprocating piston of the generic type is known from German Patent Specification No. 38 07 244.

An object of the invention is to improve the reciprocating piston of the generic type in such a way that a structural simplification of the temperature-dependent change in the compression height of the reciprocating piston is achieved.

The object is achieved according to the invention by utilizing a shape memory alloy spring for effecting temperature dependent changes in the compression height of the reciprocating piston.

The element operating as a function of temperature is formed by a spring which consists of a shape memory alloy and which interacts directly with the pressure limiting valve. Shape memory alloys which can be used to form the spring are known and available. This permits temperature-dependent change in the compression height of the reciprocating piston exclusively by the pressure limiting valve so that a structural simplification is achieved.

In an embodiment of the invention which is particularly advantageous in terms of structural simplification and with respect to assembly, the spring is located in a valve housing of the pressure limiting valve and in such a way that with increasing engine temperature, the preloading force on the valve body of the closing spring, also located in the valve housing, decreases.

Other objects, advantages and novel features of the present invention will become apparent from the following detailed description of the invention when considered in conjunction with the accompanying drawings.

DETAILED DESCRIPTION OF THE DRAWINGS

Figure 1:
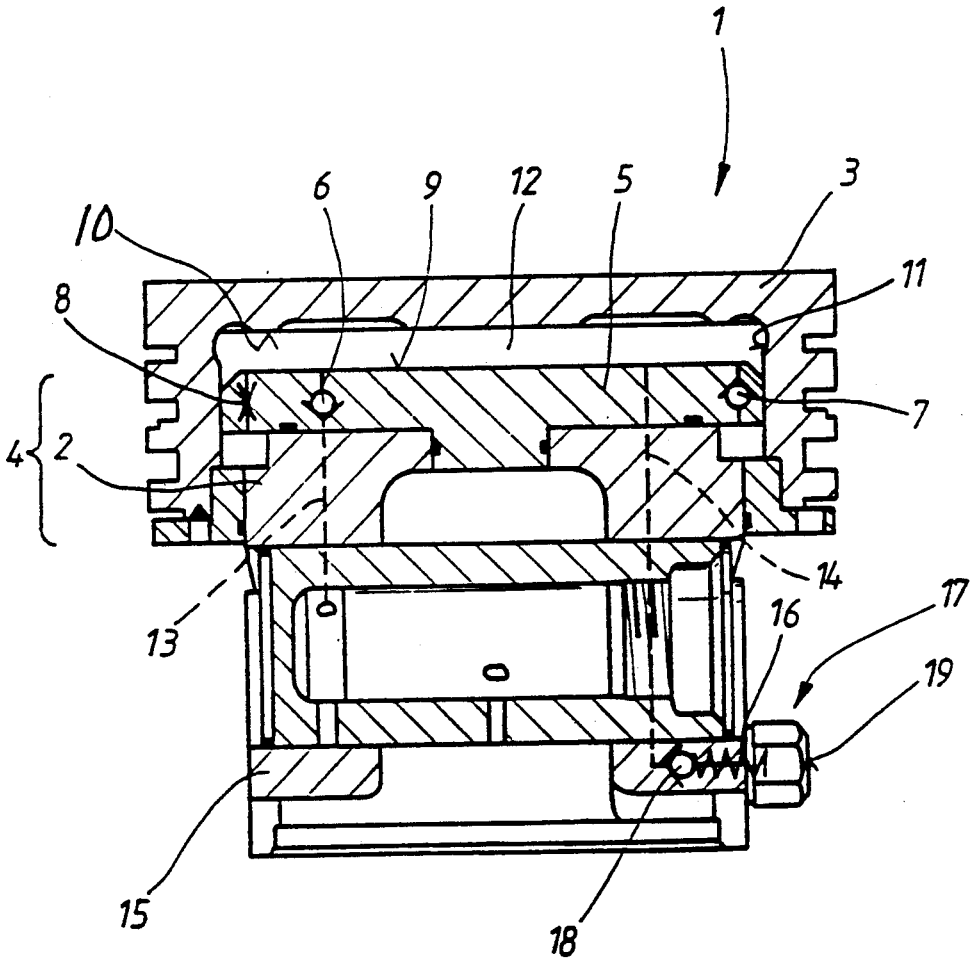
FIG. 1 shows, in longitudinal section, a reciprocating piston of variable compression height with a pressure limiting valve in an oil hole emerging into the crank case, constructed according to a preferred embodiment of the invention.

A reciprocating piston 1 in FIG. 1 is composed of an inner piston part 2 which is hinged on a connecting rod (not shown in any more detail) and an outer piston part 3. The outer piston part 3 is guided on the inner piston part 2 so that it can be displaced axially. An upper section 4 of the inner piston part 2 consists of a valve carrier plate 5, in which are located two nonreturn valves 6, 7 and a throttle valve 8.

The top of the valve carrier plate 5 forms an end surface 9 of the inner piston part 2. The end surface 9 faces towards an internal end 10 of the outer piston part 3. The surfaces of the end 10 and an internal hole wall 11 of the outer piston part 3, together with the end surface 9, form the boundaries of a control chamber 12 to which are connected, in the inner piston part 2, a first oil hole 13 for oil supply and a second oil hole 14 for oil removal. The second oil hole 14 emerging from the control chamber 12 has an outlet opening 16 to the surrounding crank case in a shank 15, not shown in any more detail. In the course of the second oil hole 14 within the shank 15 which opens towards the crank case, there is arranged a pressure limiting valve 17 which contains a spring-loaded valve body 18. The pressure limiting valve 17 can, within the scope of the invention, be inserted from outside into the second oil hole 14 through the outlet opening 16, the valve insert having an oil drain opening 19 to the crankcase in the region of the outlet opening 16.

Figure 2:
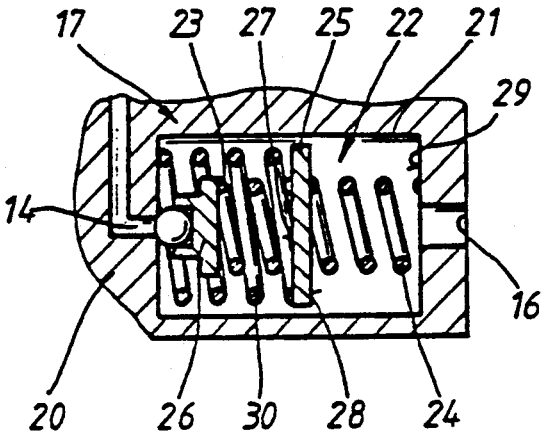
FIG. 2 shows, in an enlarged sectional view, a pressure limiting valve for the FIG. 1 arrangement with two closing springs in series and with a spring operating as a function of temperature and supported on a washer between the two closing springs, constructed according to a preferred embodiment of the invention.

FIG. 2 shows a section 20 of the shank 15 of the reciprocating piston I in which is located the pressure limiting valve 17. The pressure limiting valve 17 has a valve housing 21 formed by the shank 15 or a separate valve insert. A closing spring 22 which is composed of two spring sections 23, 24 in series is supported in the valve housing 21. The spring sections 23, 24 are separated by a washer 25. A first spring section 23 is supported on the valve body 26 designed in disc shape. Spring section 23 is also supported on a side 27 of the washer 25 which faces towards the valve body 26. A second spring section 24 is supported on a side 28 of the washer 25 remote from the valve body 26 and on an end 29 of the valve housing 21 facing towards the side 28, of the valve housing 21. The valve body 26 and the first spring section 23 are coaxially surrounded by a helical spring 30, operating as a function of temperature, which is supported on the valve housing 21, on the one hand, and on the side 27 of the washer 25, on the other, so as to act in opposition to the second spring section 24.

When the engine is cold, the helical spring 30 has a small spring force so that the closing force of the closing spring 22 acting on the valve body 26 is high and, in consequence, a high opening pressure is set at the pressure limiting valve 17. When the engine is warm, the stiffness of the helical spring 30 increases as a function of temperature. This relieves the first spring section 23 of load so that the opening pressure at the pressure limiting valve 17 decreases.

Figure 3:
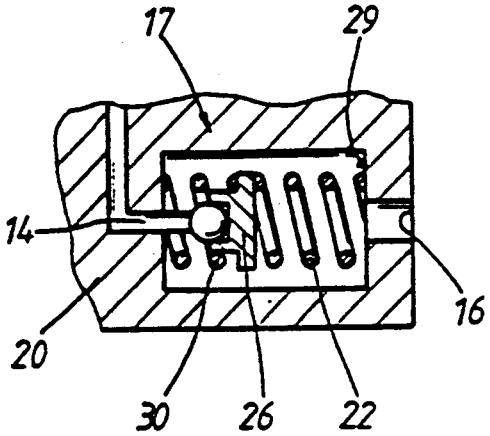
FIG. 3 shows, in an enlarged sectional view, an embodiment of the pressure limiting valve for FIG. 1 with joint, oppositely acting support, on the valve body, of the closing spring and the spring operating as a function of temperature.

As a departure from FIG. 2, the closing spring 22 is designed in one piece in FIG. 3 and is supported on the end 29 of the valve housing 21 and on the valve body 26. The helical spring 30 is supported so as to act against the closing spring 22 on the valve body 26, on the one hand, and on the valve housing 21, on the other.

When the engine is cold, the helical spring 30 has a low spring stiffness so that a major part of the preloading force of the closing spring 22 acts, via the valve body 26, on the valve seat so that there is a high opening pressure at the pressure limiting valve 17. When the engine is warm, the helical spring 30 expands and its spring stiffness increases. The spring force of the helical spring 30 acts against the preloading force of the closing spring 22 so that load is removed from the valve body 26 and, in consequence, the opening pressure at the pressure limiting valve 17 decreases.

Figure 4A:
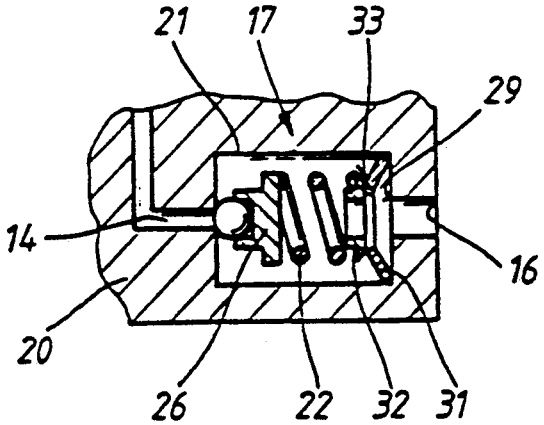
FIGS. 4*a* and 4*b* show, in enlarged sectional views, an embodiment of a pressure limiting valve for the FIG. 1 arrangement with a plate spring in series with the closing spring as the spring element operating as a function of temperature.
Figure 4B:
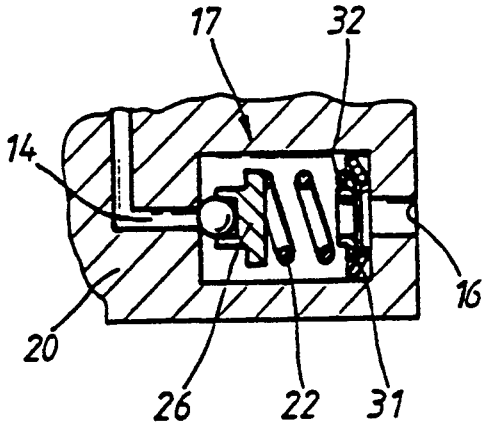

The embodiments of FIG. 4*a* and FIG. 4*b* include a pressure limiting valve 17 with a plate spring 31 operating as a function of temperature and manufactured from an alloy with shape memory properties. The plate spring 31 is in series with the closing spring 22. The closing spring 22 supported at one end on the valve body is supported at its opposite end via a support ring 32 on the protruding inner edge 33 of the plate spring 31 whose outer edge is in contact with a wall of the valve housing 21.

When the engine is cold (FIG. 4*a*), the plate spring 31 has a small spring preload. The plate spring 31 is predeflected towards the valve body 26 so that the closing spring 22 is compressed and exerts an increased pressure on the valve body 26 so that a higher opening pressure is built up at the pressure limiting valve 17. When the engine is warm (FIG. 4*b*), the plate spring 31 has a high spring preload and is therefore deflected away from the valve body 26. The closing spring 22 is lengthened as a consequence of this deflection whereupon the pressure on the valve body 26 decreases and, in consequence, the opening pressure at the pressure limiting valve 17 becomes smaller.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. Reciprocating piston arrangement with variable compression height, for internal combustion engines in particular, comprising:

a connecting rod, an inner piston part hinged on the connecting rod, an outer piston part guided on the inner piston part so that it can be displaced axially,, a control chamber located between a surface of the inner piston part and a surface of the outer piston part facing towards a piston end, to which control chamber are connected a first oil hole in the inner piston part for oil supply and a second oil hole for removal of oil from the control chamber to an engine crank case, a pressure limiting valve in the second oil hole which opens in the direction of the crank case and which has a valve body loaded by a closing spring, and a temperature responsive element provided within the extent of the second oil hole which permits a higher oil pressure in the control chamber when the engine is cold than when it is warm and which operates as a function of temperature, wherein the temperature response element is formed by a spring consisting of a shape memory alloy, which spring interacts with the pressure limiting valve.

2. Reciprocating piston arrangement according to claim 1, wherein the spring is located in a valve housing of the pressure limiting valve, and wherein the spring has a temperature response force relationship with the closing spring such that the preloading force of the closing spring on the valve body decreases with increasing engine temperature.

3. Reciprocating piston arrangement according to claim 2, wherein the temperature responsive spring is supported on the valve housing and on the valve body so as to act against the closing spring.

4. Reciprocating piston arrangement according to claim 1, wherein the closing spring is subdivided by a washer into first and second spring sections, wherein the temperature responsive spring coaxially surrounds the first spring section clamped between the valve body and washer and is supported on the washer and the valve housing.

5. Reciprocating piston arrangement according to claim 1, wherein the temperature responsive spring is a plate spring.

6. Reciprocating piston arrangement according to claim 5, wherein the closing spring is in series with the plate spring, the plate spring being supported on the closing spring, on the one hand, and on one of a valve housing and a valve body of the pressure limiting valve on the other hand.

7. Reciprocating piston arrangement according to claim 3, wherein the closing spring is subdivided by a washer into first and second spring sections, wherein the temperature responsive spring coaxially surrounds the first spring section clamped between the valve body and washer and is supported on the washer and the valve housing.

8. Reciprocating piston arrangement according to claim 7, wherein the temperature responsive spring is a plate spring.

9. Reciprocating piston arrangement according to claim 8, wherein the closing spring is in series with the plate spring, the plate spring being supported on the closing spring, on the one hand, and on one of a valve housing and a valve body of the pressure limiting valve on the other hand.

* * * * *